US005845176A

United States Patent [19]

Yoshida et al.

[11] Patent Number: 5,845,176

[45] Date of Patent: Dec. 1, 1998

[54] PROCESS UNIT HAVING MOUNTING GUIDES AND PROTECTIVE COVERS

[75] Inventors: Narutaka Yoshida; Yuzuru Sugimoto, both of Toyokawa; Hiroshi Mizuno, Aichi-ken, all of Japan

[73] Assignee: Minolta Co., Ltd., Osaka, Japan

[21] Appl. No.: 510,373

[22] Filed: Aug. 2, 1995

[30] Foreign Application Priority Data

| | | | |
|---|---|---|---|
| Aug. 4, 1994 | [JP] | Japan | 6-183809 |
| Aug. 11, 1994 | [JP] | Japan | 6-189691 |
| Aug. 11, 1994 | [JP] | Japan | 6-189692 |

[51] Int. Cl.[6] ..... G03G 21/16

[52] U.S. Cl. ..... 399/113; 399/114; 399/116; 399/119

[58] Field of Search ..... 399/113, 114, 399/116, 119, 125, 126

[56] References Cited

U.S. PATENT DOCUMENTS

| | | | |
|---|---|---|---|
| 4,460,267 | 7/1984 | Ogawa | 399/119 |
| 4,583,832 | 4/1986 | Kasamura et al. | 399/119 |
| 4,924,267 | 5/1990 | Yoshikawa et al. | 399/113 X |
| 5,061,959 | 10/1991 | Kinoshita et al. | 399/113 |
| 5,113,220 | 5/1992 | Kwak | 399/114 |
| 5,115,272 | 5/1992 | Ohmori et al. | 399/110 |
| 5,257,068 | 10/1993 | Sawada et al. | 399/125 |
| 5,343,223 | 8/1994 | Tohyama et al. | 346/108 |
| 5,353,098 | 10/1994 | Lim | 399/119 |
| 5,369,474 | 11/1994 | Yamada | 399/119 |
| 5,612,768 | 3/1997 | Kim et al. | 399/92 |

FOREIGN PATENT DOCUMENTS

| | | |
|---|---|---|
| 61-56371 | 3/1986 | Japan . |
| 2-19857 | 1/1990 | Japan . |
| 2-105184 | 4/1990 | Japan . |
| 3-100666 | 4/1991 | Japan . |
| 4-56969 | 2/1992 | Japan . |
| 6-110308 | 4/1994 | Japan . |

*Primary Examiner*—Nestor R. Ramirez
*Attorney, Agent, or Firm*—Sidley & Austin

[57] ABSTRACT

A fixed frame includes a photosensitive drum and a developing unit, and a movable frame is openable with respect to the fixed frame. The developing unit, which has two pairs of protrusions thereon, is detachably mounted to the fixed frame by engaging the protrusions with two pairs of guides provided on the fixed frame. One pair of guides includes a portion for momentarily catching one pair of the protrusions as the developing unit is being mounted to the apparatus, and each of the other pair of guides includes a inclined portion having the shape of an arc centered on the momentarily catching portion, whereby an impact to the developing unit is alleviated. The developing unit has a shutter which moves to a position for covering a peripheral surface of a developing sleeve when the developing unit is being dismounted, and which retracts from the developing sleeve covering position and moves to a position for covering the photosensitive drum when the developing unit is being mounted. The movable frame accommodates a fixing device to move the fixing device rearwardly together with the movable frame when the movable frame is opened, whereby the danger of an operator touching the fixing device when the apparatus is opened is reduced.

16 Claims, 7 Drawing Sheets

PROCESS UNIT HAVING MOUNTING GUIDES AND PROTECTIVE COVERS

BACKGROUND OF THE INVENTION

1. Field of the Invention

The present invention relates to an image forming apparatus, and in particular, an image forming apparatus utilizing an electrophotographic process that exposes and develops an image on a photosensitive drum and then transfers that image to a sheet.

2. Description of the Related Art

In recent years, various types of small-sized laser printers, which use the electrophotographic process have been offered. As indicated in U.S. Pat. No. 5,343,223, this type of laser printer is generally a clam shell type that is separated into two portions along a paper feed path of a printer main body to allow the upper portion of the frame to open with respect to the lower portion of the frame for inspections as well as removal of paper jams.

Some apparatuses of this type are constructed such that the developing unit is lowered down along guides provided on the frame on the main body side when the operator opens the upper frame to set the developing unit in the apparatus main body. For example, in U.S. Pat. No. 4,460,267, an apparatus is disclosed which mounts a developing unit along guides extending in the direction of the photosensitive drum from the upper portion of the apparatus.

In an apparatus of this type, if the operator inadvertently lowers down the developing unit, the developing unit will strike the photosensitive drum or its supporting member, which results in damage to the photosensitive drum and deviations in the supporting position.

Further, the above apparatus is provided with a shutter to shield the developing sleeve when the developing unit is removed to the outside. This shutter retracts from the shielding position when the developing unit is set in the main body and the developing sleeve is made to face the photosensitive drum. However, when the upper frame of the main body is opened with the developing unit set in the main body, measures to protect the photosensitive drum against light or objects from the outside are left unanswered. Further, when the developing unit is removed to the outside, measures to protect the photosensitive drum against light or objects from the outside are also left unanswered.

Thereupon, in a printer using the above electrophotographic process, a fixing assembly is arranged to fix toner to the terminating portion of the paper feed path. When the power supply is turned ON, this fixing assembly generates a considerable amount of heat. Therefore, if the fixing assembly remains in the paper feed path when the main body of the apparatus is opened to remove jammed paper, there is a possibility that it will interfere with the removal of the jammed paper or the operator may inadvertently touch the fixing assembly and burn himself.

SUMMARY OF THE INVENTION

The main object of the present invention is to provide an image forming apparatus that can prevent a developing unit from being struck when mounted in the main body of the apparatus.

Another object of this invention is to provide an image forming apparatus that shields the developing sleeve when the developing unit is removed from the main body, and that opens the developing sleeve and at the same time protects the photosensitive drum when the developing unit is mounted to the main body.

Another object of this invention is to provide an image forming apparatus which is able to easily remove paper jams to and simply execute maintenance and inspections inside the apparatus.

Another object of this invention is to eliminate as much as possible the danger of the operator touching the fixing assembly when opening the main body of the apparatus.

These and other objects, advantages and features of the invention will become apparent from the following description thereof taken in conjunction with the accompanying drawings with illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
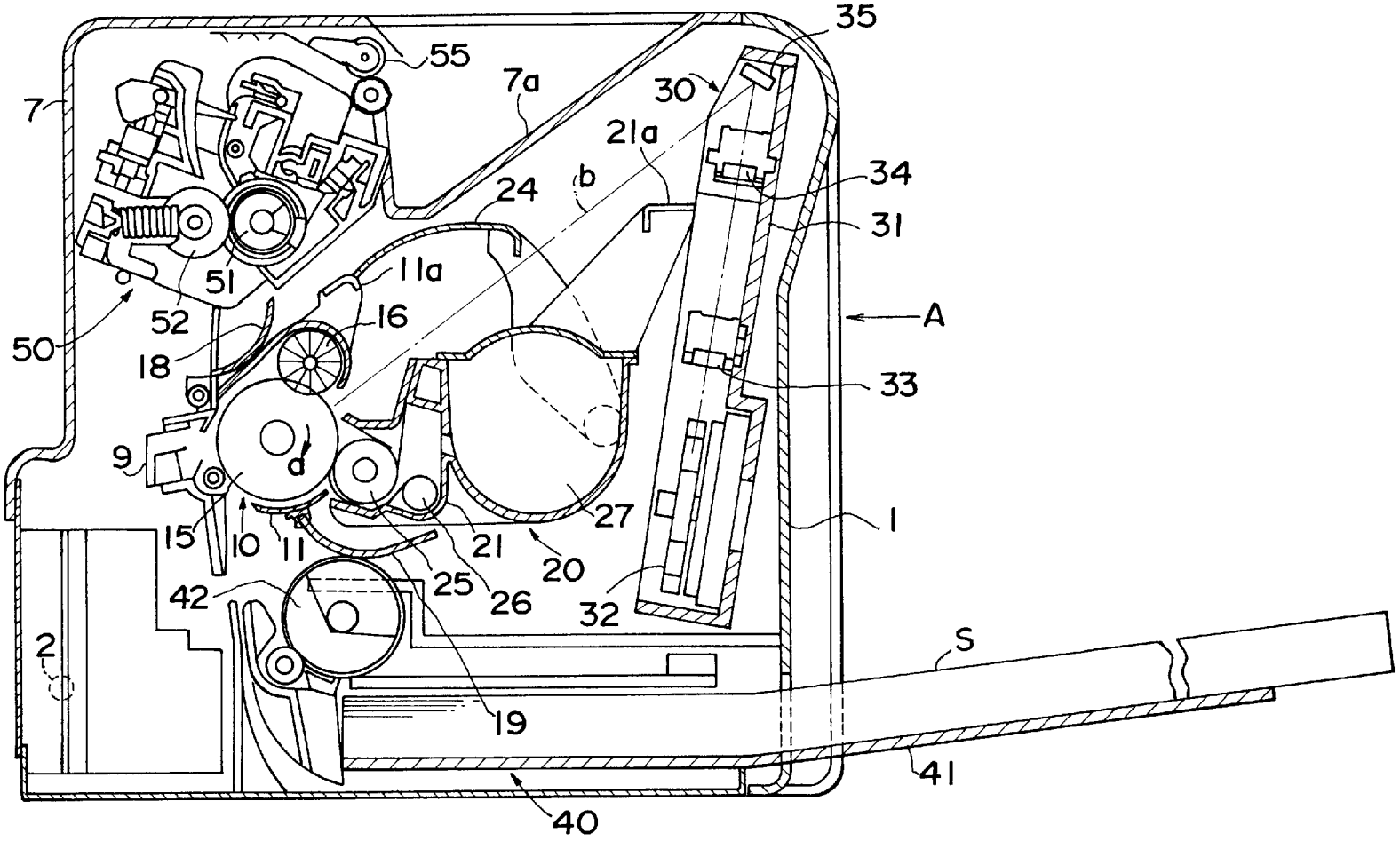
FIG. 1 is a cross-sectional view showing the internal construction of the laser printer in one embodiment of this invention.

Referring now to the drawings, an image forming apparatus according to one preferred embodiment of the present invention will be described.

The embodiment described below applies this invention to a laser printer.

The laser printer has a photosensitive unit 10 (see FIG. 3) and a developing unit 20 (see FIG. 4) in the center portion, a laser scanning optical unit 30 arranged at the right side, a sheet feeder portion 40 arranged at the lower portion, and a fixing assembly 50 arranged at the upper portion in FIG. 1.

The main body of the printer is constructed as a clam shell type separated into two portions, one of which is a fixed frame 1 and the other is a movable frame 7, and the direction shown by arrow A is the front. Namely, the operator faces the printer in the direction of arrow A to set the print conditions and remove jams. As described below, the photosensitive unit 10 and developing unit 20 are installed on the fixed frame 1 to be freely mountable and demountable, and the laser scanning optical unit 30 is installed on the front of the fixed frame 1. The fixing assembly 50 comprises a heating roller 51 and a pressure roller 52 and is mounted on the movable frame 7, namely, towards the inside away from the operator standing in front of the printer.

Figure 2:
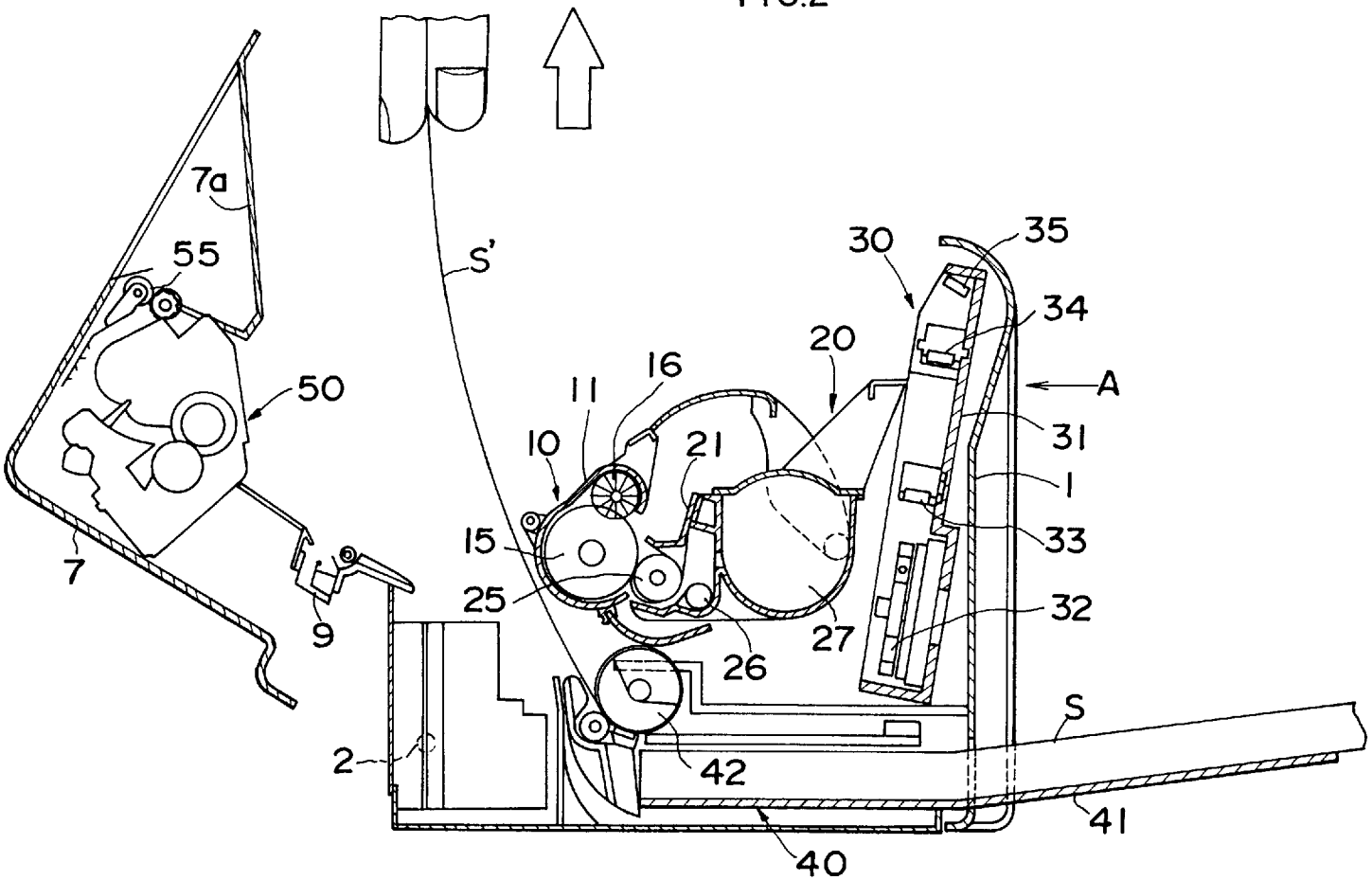
FIG. 2 is a cross-sectional view showing the main body of said laser printer in an open state.

The movable frame 7 can be rotated on a support axis 2, provided on the fixed frame 1, that acts as a fulcrum: and by raising and rotating it towards the rear, the main body of the printer can be opened upwardly (see FIG. 2).

The photosensitive unit 10 has a photosensitive drum 15 and a charging brush 16 housed inside a casing 11 and the photosensitive drum 15 can rotate in the direction of arrow a. A transfer charger 9 is mounted on the movable frame 7 opposite this photosensitive drum 15.

The developing unit 20 has a developing sleeve 25 and a developing agent stirring roller 26 housed inside a casing 21, and toner stored in a tank 27 is suitably supplied to the stirring roller 26. The toner is supplied to the outer peripheral surface of the developing sleeve 25 while the developing agent is being stirred with the toner by the stirring roller 26.

The laser scanning optical unit 30 is formed by storing a laser diode (not shown in figure), a polygon mirror 32, lenses 33 and 34, and a mirror 35 inside a housing 31 and, based on image information to be transferred from an external host apparatus (for example, a microcomputer), it modulates the light from the laser diode, deflects laser beam by means of the polygon mirror 32 to irradiate the surface of the photosensitive drum 15 through light path b from the mirror 35.

A sheet feeder portion 40 is arranged so as to insert sheets S onto a sheet feeding plate 41 from the front side. The sheets are fed one-by-one from the uppermost layer by the rotation of a sheet pick-up roller 42. A sheet is fed and then the sheet with the transferred image is immediately separated from the photosensitive drum 15 and transported upwardly where fixing of the toner is carried out by passing between rollers 51, 52 of the fixing assembly 50 and then the sheet is discharged from a pair of discharge rollers 55 to a discharge tray 7*a*. This discharge tray 7*a* is constructed integrally with the movable frame 7.

Further, each image forming process of exposure, developing and transfer in this laser printer is well known so a detailed description will be omitted.

Next, the mounting/demounting construction of the photosensitive unit 10 and developing unit 20, and each type of shutter member will be described as well as their operation.

The photosensitive unit 10 is mounted and demounted by moving the plate 13, fixed to both sides of the casing 11 by a pin 12, up and down in a guide channel 4 (see FIG. 7) formed on both side walls of the fixed frame 1 and has a handle 11*a* for mounting and demounting. The guide channel 4 extends in the vertical direction, and when the plate 13 reaches the bottom portion of the guide channel 4, the photosensitive unit 10 is set at a prescribed position.

The developing unit 20 is mounted and demounted by moving the guide pins 22 and 23, protruding on both sides of the casing 21, up and down inside the guide channels 5, 6 (see FIG. 7) formed on both side walls of the fixed frame 1 and has a handle 21*a* for mounting and demounting.

The first guide channel 5 comprises an inlet portion 5*a*, a first inclined portion 5*b*, and a second inclined portion 5*c*. The second guide channel 6 comprises an inlet portion 6*a* and a vertical portion 6*b* extending in the vertical direction at a position shifted slightly inwardly from this inlet portion 6*a*. When the developing unit 20 is mounted to the main body, at first, the guide pins 22, 23 are positioned at the inlet portions 5*a*, 6*a* of the first and second guide channels 5, 6 (see FIG. 7) and then the developing unit 20 is made to rotate in the downward direction at the inside of the casing 21 by the guide pin 23 acting as a fulcrum. During this time, the guide pin 22 is guided along the first inclined portion 5*b* moving in the downward direction. Then, for a moment the guide pin 22 becomes caught at the connecting part of the inclined portions 5*b* and 5*c*, immediately after which it enters the second inclined portion 5*c* by the weight of the developing unit 20. Along with this, the guide pin 23 moves from the inlet portion 6a to the vertical portion 6*b* (see FIG. 8). Thereafter, when the operator gradually loosens his grip on the developing unit 20, the guide pin 22 moves in the downward direction to the second inclined portion 5*c* along with the guide pin 23 moving in the downward direction to the vertical portion 6*b* and each pin 22 and 23 reaching the bottom portion of each guide channel 5 and 6, which sets the developing unit 20 at a prescribed position (see FIG. 9).

Figure 5:
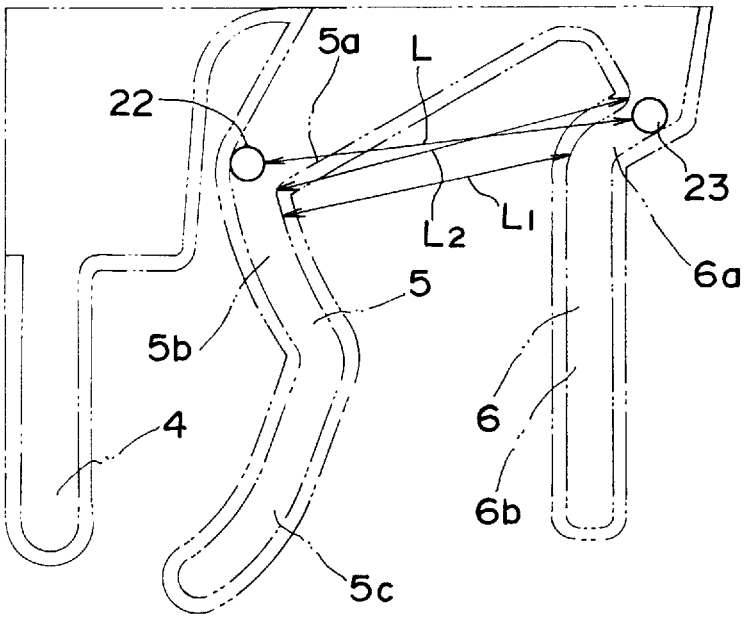
FIG. 5. is an elevational view showing the guide channel.

As shown in FIG. 5, in order to ensure the mounting operation described above, the gap L between the guide pins 22 and 23 is set larger than the gap L1 between the guide channels 5 and 6 as well as being set smaller than the gap L2 between the guide channels 5 and 6. Further, the inlet portion 6*a* of the guide channel 6 has a level drop to catch the guide pin 23 with respect to the vertical portion 6*b*. Consequently, when mounting the developing unit 20, the guide pin 23 is caught at the inlet portion 6*a* for a moment, thereby alleviating any impact during the mount without suddenly falling in the guide channels 5 and 6.

Figure 8:
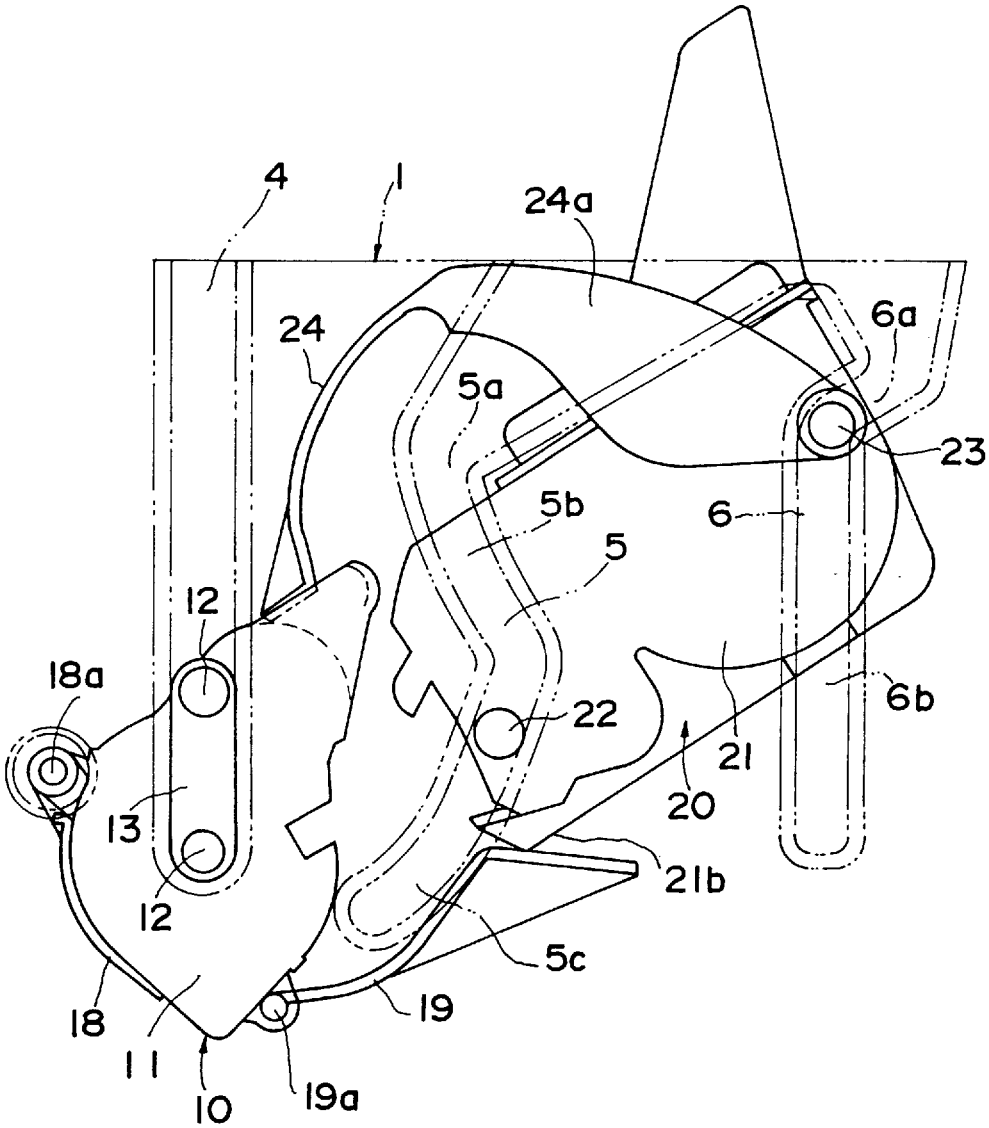
FIG. 8 is an expanatory view showing the mounting operation for the developing unit.
Figure 9:
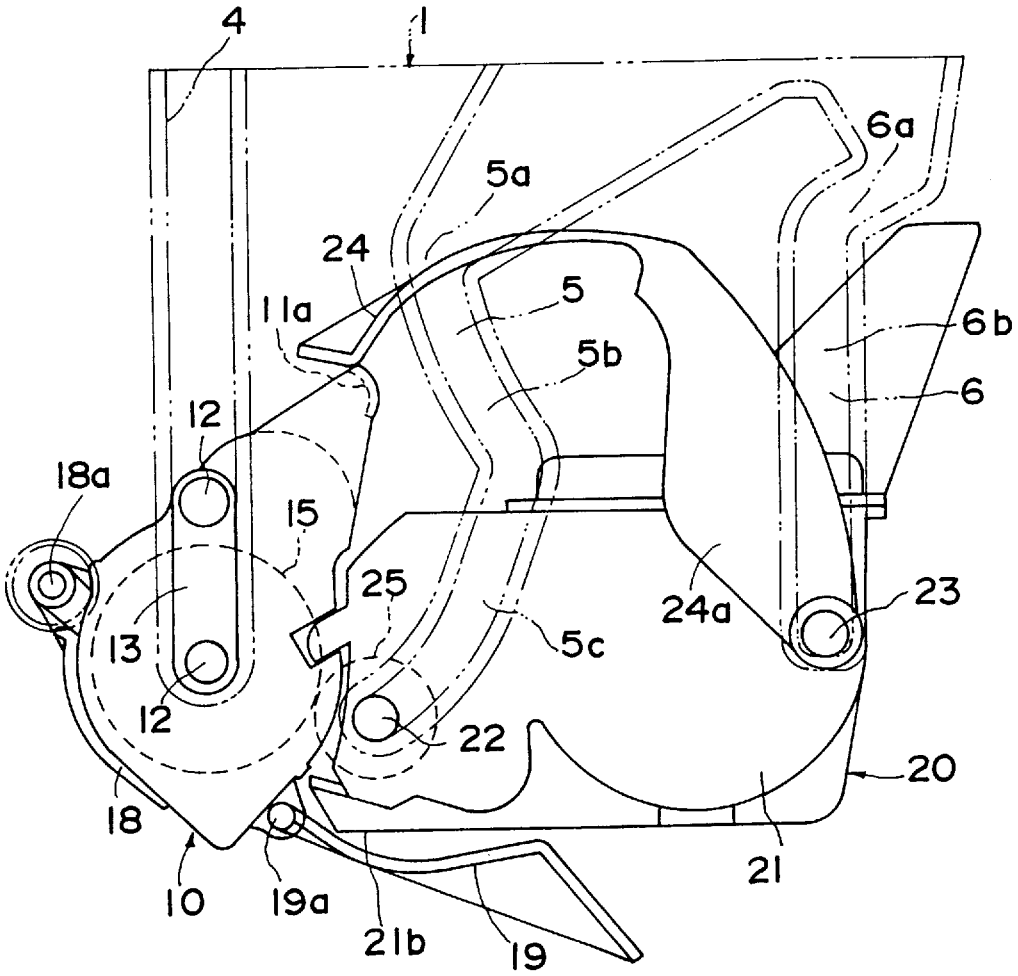
FIG. 9 is an explanatory view showing the mounting operation for the developing unit.

Furthermore, the first inclined portion 5*b* of the guide channel 5 curves in a semicircular arc shape centered on the portion with a level drop of the guide channel 6, and the second inclined portion 5*c* continuously extends the photosensitive drum 15 from the first inclined portion 5*b*. Therefore, as shown in FIG. 8, the developing unit 20 pivots in the counterclockwise direction and, as shown in FIG. 9, while pivoting in the clockwise direction its position is adjusted and it smoothly approaches the photosensitive drum 15. Lastly, the impact which would otherwise occur when the developing unit 20 is set at the bottom portion of the guide channels 5 and 6 is alleviated.

Figure 6:
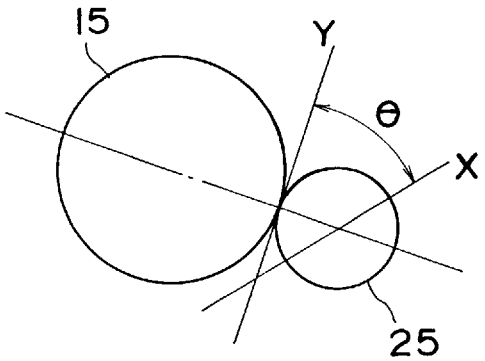
FIG. 6 is an explanatory view showing the adjacent state of the de loping unit with respect to the photosensitive drum.

In particular, as shown in FIG. 6, in order to alleviate the impact to the photosensitive drum 15 when mounting the developing unit 20, it is preferable that angle θ at which line X showing the direction of movement of the developing sleeve 25 meets tangent line Y is an acute angle ($0° < \theta < 90°$).

Figure 3:
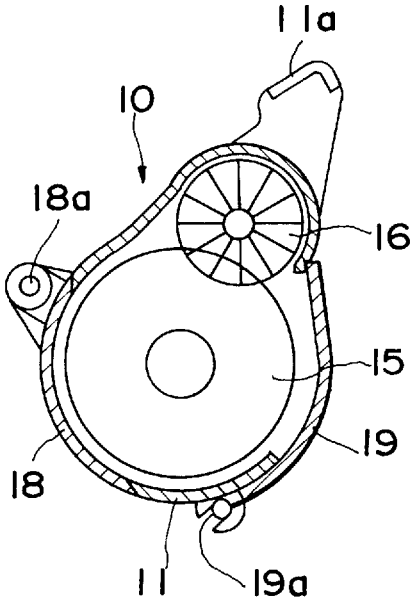
FIG. 3 is a cross-sectional view showing the photosensitive unit.

Thereupon, the photosensitive unit 10 is equipped with a first shutter plate 18 and a second shutter plate 19 as one part of the casing 11 (see FIG. 3). The first shutter plate 18 is installed to be rotatable on a pin 18*a*, provided on the casing 11, and a torsion spring (not shown in figure) always applies force to the first shutter plate 18 in the counterclockwise direction. When the photosensitive unit 10 is removed from the main body and when the main body is opened, this first shutter plate 18 covers behind the photosensitive drum 15, namely the transfer region, by the spring force of the torsion spring. When the movable frame 7 is closed, a protrusion (not shown in figure) provided on the movable frame 7 presses the first shutter plate 18, moving the first shutter plate 18 in the clockwise direction with the pin 18*a* acting as a fulcrum and then retracts in the upward direction to open the transfer region (see FIG. 1).

Figure 7:
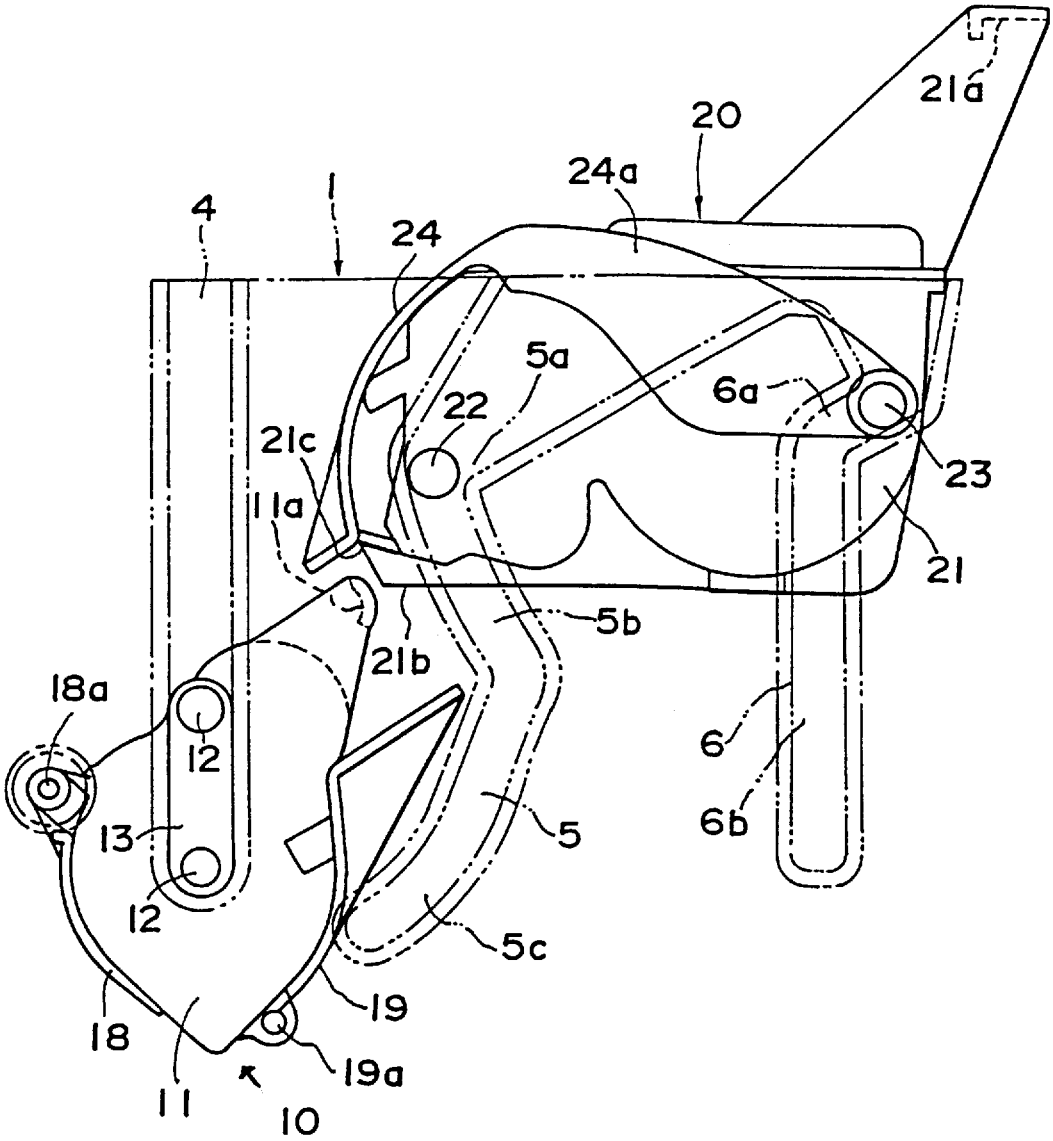
FIG. 7 is an explanatory view showing the mounting operation for the developing unit.

The second shutter plate 19 is installed to be rotatable on a pin 19*a* provided on the casing 11 and a torsion spring (not shown in figure) always applies force to the second shutter plate 19 in the counterclockwise direction. When the photosensitive unit 20 is removed from the main body, this second shutter plate 19 covers the developing region of the photosensitive drum 15 by the spring force of the torsion spring (see FIGS. 3 and 7). Therefore, as shown in FIG. 7, the second shutter plate 19 covers and protects the developing region of the photosensitive drum 15 at the initial stage of the mounting of the developing unit 20. When the developing unit 20 is mounted on the fixed frame 1 along the guide channels 5 and 6, a corner portion 21*b* of the casing 21 makes contact with and presses against the second shutter plate 19 in the downward direction and the second shutter plate 19 rotates in the clockwise direction with the pin 19*a* acting as a fulcrum to retract the second shutter plate 19 in the downward direction and open the developing region (see FIGS. 1 and 9).

Figure 4:
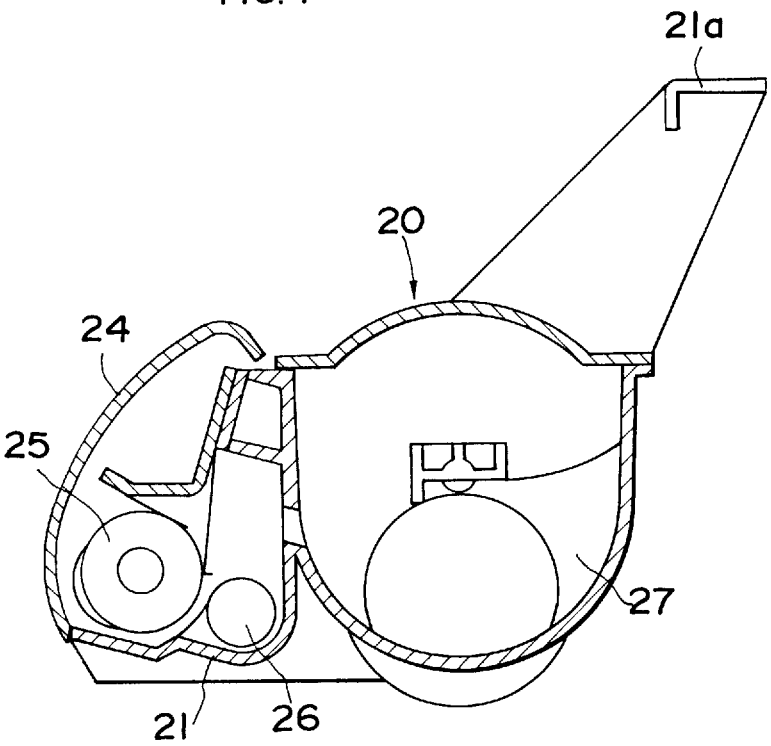
FIG. 4 is a cross-sectional view showing the developing unit.

Conversely, a shutter plate 24 is installed on the developing unit 20 as one part of the casing 21 (see FIGS. 4 and 7). This shutter plate 24 has a side plate 24*a* on both sides and is supported to be rotatable on said guide pin 23 on the edge of the side plate 24*a*. When the developing unit 20 is separated from the main body (see FIGS. 4 and 7), the shutter plate 24 rotates in the counterclockwise direction by its own weight until the tip makes contact with the corner portion 21*c* of the casing 21 to cover the developing sleeve 25. When the developing unit 20 is mounted to the fixed frame 1, the shutter plate 24 opens the developing sleeve 25 by its tip making contact with the handle 11*a* of the photosensitive unit 10 to rise in the upward direction (see FIG. 9).

In this embodiment, as stated above, the shutter plate 24 covers the external periphery of the developing sleeve 25 when the developing unit 20 is separated from the fixed frame 1, thus preventing toner scattering and the operator's hands from becoming soiled. On the other hand, when the developing unit 20 is mounted to the fixed frame 1, the shutter plate 24 retracts upwardly facing the developing sleeve 25 towards the photosensitive drum 15 along with covering the upper portion of the photosensitive drum 15 (see FIG. 1). At this time, the exposure light path b irradiated from the laser scanning optical unit 30 passes between the opposing side plates 24*a* and below the lower portion of the shutter plate 24 so as to strike the photosensitive drum 15, as shown in FIG. 1. Further, as shown in FIG. 2, when paper jam S' is removed or internal maintenance and inspection is carried out, the movable frame 7 is rotated backwardly to open the main body and, at this time, the photosensitive drum 15 is protected by the shutter plate 24. Thus, this prevents stress on the photosensitive drum due to light from outside or damage due to contact with another body.

Moreover, in this embodiment, the photosensitive unit 10 is equipped with the first shutter plate 18 and the second shutter plate 19. When the main body is opened, the first shutter plate 18 protects the transfer region of the photosensitive drum 15 and when the developing unit 20 is separated, the second shutter plate 19 protects the developing region of the photosensitive drum 15.

Thereupon, in this embodiment, when a jam of sheets S occurs or the photosensitive unit 10 and/or developing unit 20 must be replaced or an internal inspection becomes necessary, the movable frame 7 is rotated backwardly on the support axis 2 acting as a fulcrum to open the main body (see FIG. 2). At this time, the fixing assembly 50 moves integrally with the movable frame 7 retracting backwardly. Therefore, the upper portion of the fixed frame 1 opens to a large space, which makes it easy to remove paper jam S'. Of course, replacing internal parts, as well as maintenance and inspections are easy also. Furthermore, the fixing assembly 50, which had been operating until then, is heated to a considerably high temperature when removing a paper jam. However, because the fixing assembly 50 retracts backwardly where is separated from the operator who is positioned in front of the apparatus, the danger of the operator touching the fixing assembly 50 is reduced.

Moreover, in this embodiment, the transfer charger 9 is mounted on the movable frame 7. Consequently, as shown in FIG. 2, the transfer charger 9 also retracts backwardly when opening the main body so that the paper path is wide opened. This makes it even easier to remove paper jams.

Also, when the developing unit 20 is mounted, the guide pin 23 is held for a moment at a level drop of the inlet portion 6*a*, thereby alleviating any impact during the mount without suddenly dropping the guide pins 22 and 23 in the guide channels 5 and 6.

Moreover, the image forming apparatus related to this invention is not limited to said embodiment and can be modified in various ways within the range of the claims.

In particular, the clam shell mechanism of the main body or the mounting and demounting mechanism of the photosensitive unit and developing unit can be freely modified. Further, the photosensitive drum can be fixed to the main body as well.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electrophotographic image forming apparatus comprising:

a main body;

a photosensitive drum;

a developing unit which is detachably mounted in said main body by insertion generally along a mounting direction, said developing unit having a pair of protrusions, each of said protrusions protruding in a direction perpendicular to said mounting direction; and a pair of guides provided on said main body for receiving and engaging said protrusions, said guides guiding said developing unit generally along said mounting direction to a position facing said photosensitive drum, each of said pair of guides having an inlet portion, a portion for momentarily catching said protrusions as the developing unit is being mounted to the main body of the apparatus, and a lower portion which extends downwardly from said portion for momentarily catching, thereby alleviating any impact to the developing unit during the mounting.

2. An electrophotographic image forming apparatus comprising:

a main body;

a photosensitive drum;

a developing unit which is detachably mounted in said main body by insertion generally along a mounting direction, said developing unit providing a pair of first protrusions and a pair of second protrusions, each of the protrusions protruding in a direction perpendicular to the mounting direction;

a pair of first guides provided on the main body of the apparatus for engaging said pair of first protrusions; and a pair of second guides provided on the main body of the apparatus for engaging said pair of second protrusions, said first and second guides guiding said developing unit to a position facing said photosensitive drum, said pair of first guides having a portion for momentarily catching said pair of first protrusions as the developing unit is being mounted to the main body of the apparatus and a lower portion extending downwardly from the portion for momentarily catching, thereby alleviating any impact to the developing unit during the mounting.

3. The image forming apparatus as claimed in claim 2, wherein the main body of the apparatus is separable into a fixed frame and a movable frame, said movable frame being openable upwardly with respect to the fixed frame, and wherein said photosensitive drum and developing unit are accommodated in the fixed frame.

4. The image forming apparatus as claimed in claim 3, wherein said developing unit has a shutter member which constitutes a part of a housing of the developing unit, wherein the shutter member moves to a first position for covering a portion of a peripheral surface of the developing sleeve when the developing unit is being demounted from the main body of the apparatus, and wherein the shutter member retracts from the first position and moves to a second position for covering a portion of the photosensitive drum when the developing unit is being mounted to the main body of the apparatus.

5. The image forming apparatus as claimed in claim 4, wherein said developing unit is demountable upwardly from said fixed frame when the movable frame is opened, and wherein the shutter member moves to a position over a path of exposure light emitted toward the photosensitive drum so as to cover a portion of the photosensitive drum.

6. The image forming apparatus as claimed in claim 4 further comprising a photosensitive member unit which includes said photosensitive drum therein, said photosensitive member unit being detachably mounted on the main body, said photosensitive member unit providing a movable shutter which constitutes a part of a housing of the photosensitive member unit to cover a developing region of a peripheral surface of the photosensitive drum, wherein said movable shutter retracts from a position for covering the photosensitive drum to open the developing region when said developing unit is being mounted to the main body of the apparatus, and wherein said movable shutter returns to the position for covering the photosensitive drum when said developing unit is being demounted from the main body of the apparatus.

7. The image forming apparatus as claimed in claim 3, wherein the movable frame accommodates a fixing device, for fixing toner image onto a recording paper, so as to move the fixing device together with said movable frame when said movable frame is opened.

8. The image forming apparatus as claimed in claim 7, wherein said movable frame further accommodates a transfer charger.

9. An electrophotographic image forming apparatus comprising:

a main body;

a photosensitive drum;

a developing unit which is detachably mounted in said main body by insertion generally along a mounting direction for the developing unit which is perpendicular to an axis of said photosensitive drum, said developing unit providing a pair of first protrusions and a pair of second protrusions, wherein each of the first and second protrusions protrudes in a direction perpendicular to the mounting direction for the developing unit;

a pair of first guides provided on said main body for guiding said pair of first protrusions, each of said first guides having a portion for momentarily catching said first protrusions as the developing unit is being mounted to the main body of the apparatus and a lower portion which extends downwardly from said portion for momentarily catching; and a pair of second guides provided on the main body of the apparatus and extending to a position facing said photosensitive drum for guiding said second protrusions, each second guide including a inclined portion having a shape which is substantially that of an arc centered on the portion of a respective one of said first guides for momentarily catching said first protrusions.

10. The image forming apparatus as claimed in claim 9 wherein each said second guide further includes a second inclined portion which is connected with a respective first inclined portion and which extends in a direction which is different from a direction of inclination of said respective first inclined portion so that each said second protrusion is in a respective first inclined portion when each said first protrusion is in the respective level drop portion, and wherein each said second protrusion is guided by the respective second inclined portion while each said first protrusion is guided by the lower portion of the respective first guide.

11. An image forming apparatus comprising:

a body of the apparatus;

a photosensitive drum; and a developing unit, said developing unit being demountable with respect to the body of the apparatus and including a developing sleeve and a shutter member, said shutter member constituting a part of a housing of the developing unit, the shutter member moving to a first position for covering a peripheral surface of the developing sleeve when the developing unit is being demounted from the body of the apparatus, and the shutter member retracting from the first position and moving to a second position for covering a portion of the photosensitive drum when the developing unit is being mounted to the body of the apparatus so that the photosensitive drum is protected by the shutter member in its second position when the body of the apparatus is being opened.

12. The image forming apparatus as claimed in claim 11, wherein said developing unit is mounted and demounted in a direction perpendicular to an axial direction of the photosensitive drum.

13. The image forming apparatus as claimed in claim 11, wherein the body of the apparatus is separable into two parts, one of which is a fixed frame and the other one of which is a movable frame, said movable frame being openable upwardly with respect to the fixed frame, and wherein said photosensitive drum and said developing unit are accommodated in the fixed frame so that the developing unit is demountable upwardly from the fixed frame when the movable frame is opened.

14. The image forming apparatus as claimed in claim 11, wherein said second position is a position over a path of exposure light emitted to the photosensitive drum and wherein said shutter in said second position covers an upper portion of the photosensitive drum.

15. An image forming apparatus comprising:

a body of the apparatus;

a photosensitive member unit having a first shutter member, said first shutter member constituting a part of a housing of the photosensitive member unit and being movably attached to the housing to cover a portion of the photosensitive member; and a developing unit, said developing unit being detachable with respect to the body of the apparatus and providing a developing sleeve and a second shutter member, said second shutter member constituting a part of a housing of the developing unit;

wherein, as the developing unit is being mounted to the body of the apparatus, said first shutter member retracts from its position for covering a portion of the photosensitive member to open a developing region of the photosensitive member and, at the same time, said second shutter member retracts from its position for covering the developing sleeve to its position for covering a portion of the photosensitive member; and wherein, as the developing unit is being demounted from the body of the apparatus, said first shutter member returns to its position for covering a portion of the photosensitive member and said second shutter member returns to its position for covering the developing sleeve.

16. A developing unit which is suitable for mounting in and demounting from a body of an apparatus containing a photosensitive drum, said developing unit comprising:

a developing sleeve; and a shutter member which constitutes a part of a housing of the developing unit, said shutter member moving to a first position for covering a peripheral surface of the developing sleeve as the developing unit is being demounted from the body, and said shutter member retracting from the first position to a second position for covering a portion of the photosensitive drum as the developing unit is being mounted to the body so that the photosensitive drum is protected by the shutter member in its second position when the body of the apparatus is being opened.

* * * * *